US005951148A

United States Patent [19]

Limber

[11] Patent Number: 5,951,148

[45] Date of Patent: Sep. 14, 1999

[54] ILLUMINATION SHIELD FOR USE WITH LIGHT STRINGS

[76] Inventor: Jamie A. Limber, 1608 E. Tremaine Ave., Gilbert, Ariz. 85234

[21] Appl. No.: 08/977,403

[22] Filed: Nov. 24, 1997

[51] Int. Cl.[6] ..... F21V 33/00

[52] U.S. Cl. ..... 362/255; 362/227; 362/237; 362/806; 362/248

[58] Field of Search ..... 362/255, 806, 362/377, 241, 237, 248, 247, 227, 123

[56] References Cited

U.S. PATENT DOCUMENTS

| | | | |
|---|---|---|---|
| 1,129,125 | 2/1915 | Rubin | 362/377 |
| 1,625,407 | 4/1927 | Bir | 362/255 X |
| 5,221,140 | 6/1993 | Oshino | 362/255 |
| 5,359,506 | 10/1994 | Koleno | 362/248 |
| 5,593,233 | 1/1997 | Koizumi | 362/255 |

*Primary Examiner*—Laura K. Tso
*Attorney, Agent, or Firm*—Halvorson & Venable, P.C

[57] ABSTRACT

The present invention is a device that is adapted to be received over individual lighting elements of an ornamental light string. The preferred form of the device is a body of primarily unitary construction and having an open end and a closed end. The lighting element is received through the open end and into the body of the device. The diameter of the open end is adapted to snugly fit around the outer diameter of the light element for frictive adhesion. The device of the present invention is adapted to substantially block any light emitted from the lighting element such that remote viewers are unable to detect them. In alternate embodiments, the device of the present invention is modified to allow a reduced amount of luminosity to escape thereby rendering the covered lighting element dimmer than an uncovered element. Additionally, the present invention may be included with traditional ornamental lighting strings in a kit form.

12 Claims, 5 Drawing Sheets

ILLUMINATION SHIELD FOR USE WITH LIGHT STRINGS

FIELD OF THE INVENTION

The present invention relates to the field of ornamental light strings, such as Christmas decoration lamp strings, and their decorative uses. More particularly, the invention relates to opaque devices that shield individual lamp bulbs to prevent unwanted light emission.

BACKGROUND

Holiday seasons are festive events encouraging the decoration of buildings. Historically, strings of ornamental lights have been popular trimming devices attached to indoor and outdoor trees, fences, building edges and corners, door jambs, window edging, walls and the like. A tremendous amount of ingenuity is displayed in the decorative placement of these ornamental lighting strings.

Two designs of ornamental light strings have become popular, serially powered and parallelly powered. In both designs, there are first and second adjacent conductors or wires. Serially powered light strings have each individual light element electrically attached in a serial fashion to adjacent light elements linearly along the conductors. Thus, when a single light element fails, the light string circuit is interrupted preventing all of the light elements from emitting. Parallelly powered light strings have each individual light element attached at one end to the first conductor and attached at an opposite end to the second conductor, forming a "ladder" type of electrical circuit. Thus, when a single light element fails, the light string circuit is not interrupted and only the failed light element ceases to emit. Male and female power plug members may be provided at opposite ends of the two conductors or at a single end.

In decorating buildings, multiple light strings are often serially connected forming a single extended length of light strings. However, there are many instances in ornamentation when a gap in the lighting string is desired. For example, the space found between letters and words or the like should not be illuminated to create the illusion of discrete letters and words.

If parallelly powered light strings are used for the decoration, a single bulb in the string may be loosened or removed where the gap is desired. However, this practice is disfavored for safety and other reasons.

Therefore, it would be useful to create a device that masks or prevents the emission of light from individual light elements of a string without electrically interrupting the light string electrical circuit or creating other problems.

A review of related art shows several examples of devices created for use with ornamental light strings and individual light elements. The most common devices found are transparent covers that protect an enclosed light element. See for example, U.S. Pat. No. 5,184,890 issued to Chen et al.; U.S. Pat. No. 5,499,174 issued to Lin; and U.S. Pat. No. 5,517,394 also issued to Lin.

Other types of devices partially or temporarily occlude light emission from light sources. Examples of this type of device are found in U.S. Pat. No. 5,083,251 issued to Parker. The Parker patent details a thermochromic coating for incandescent light bulbs or the like. As the thermochromic coating heats up, such as when the light bulb is turned on, the coating or cover becomes progressively more transparent thereby serving as an automatic intensity rheostat. Another example is U.S. Pat. No. 5,274,537 issued to Altman. The Altman patent details ornamental light covers that partially occlude the emission of light. Much of the ornamentality of these devices depends upon at least partial emission of light.

However, none of the found related art teaches or discloses devices that would allow selective occlusion of specific lights in an ornamental lighting string. Therefore, it would be an advantage to provide a device that quickly and easily creates a lighting void or gap in a lighting string.

SUMMARY OF THE INVENTION

It is an object of the present invention to provide a device which creates voids or gaps in lighting strings.

It is another object of the present invention to provide a device that can be attached to a lighting element in a lighting string and that prevents light from reaching a distant observer.

It is a further object of the present invention to provide a device that is removably attachable to lighting elements in a lighting string and when attached to the lighting elements prevent light from being seen by a remote observer.

It is yet another object of the present invention to provide an ornamental lighting cover that is adapted to cover an individual lighting element and is adapted to prevent light emitted by the individual lighting element from been seen by remote observers.

It is yet a further object of the present invention to provide a kit including an ornamental lighting string in combination with light element covers that are adapted to be removably attached to individual light elements and are used to create voids or gaps in the lighting provided by the included lighting string.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION OF PREFERRED EMBODIMENTS

Figure 1:
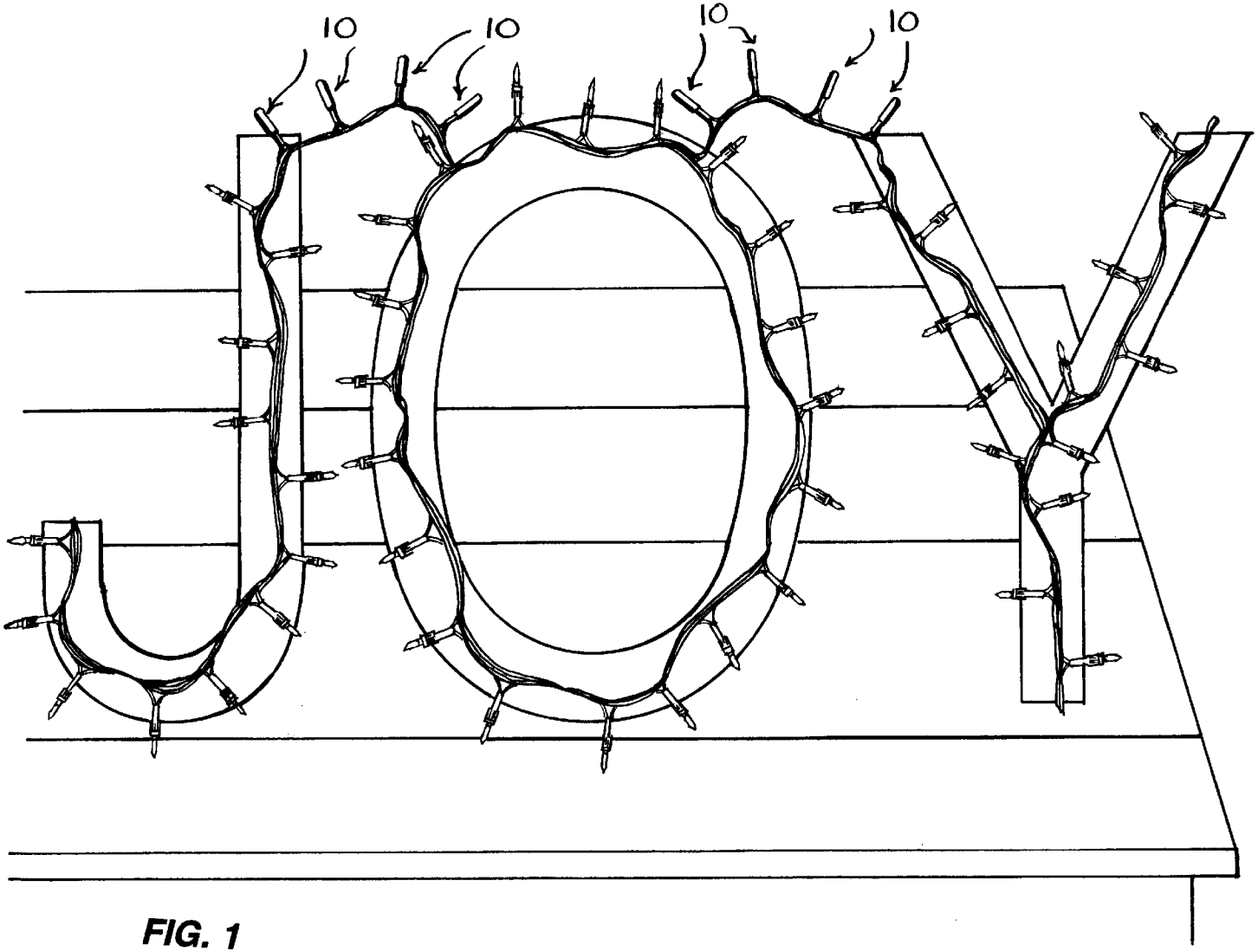
FIG. 1 shows the lighting accessory as used with an ornamental lighting string to block the light emitted from those lighting elements in the gaps between the letters in the word "JOY"
Figure 2:
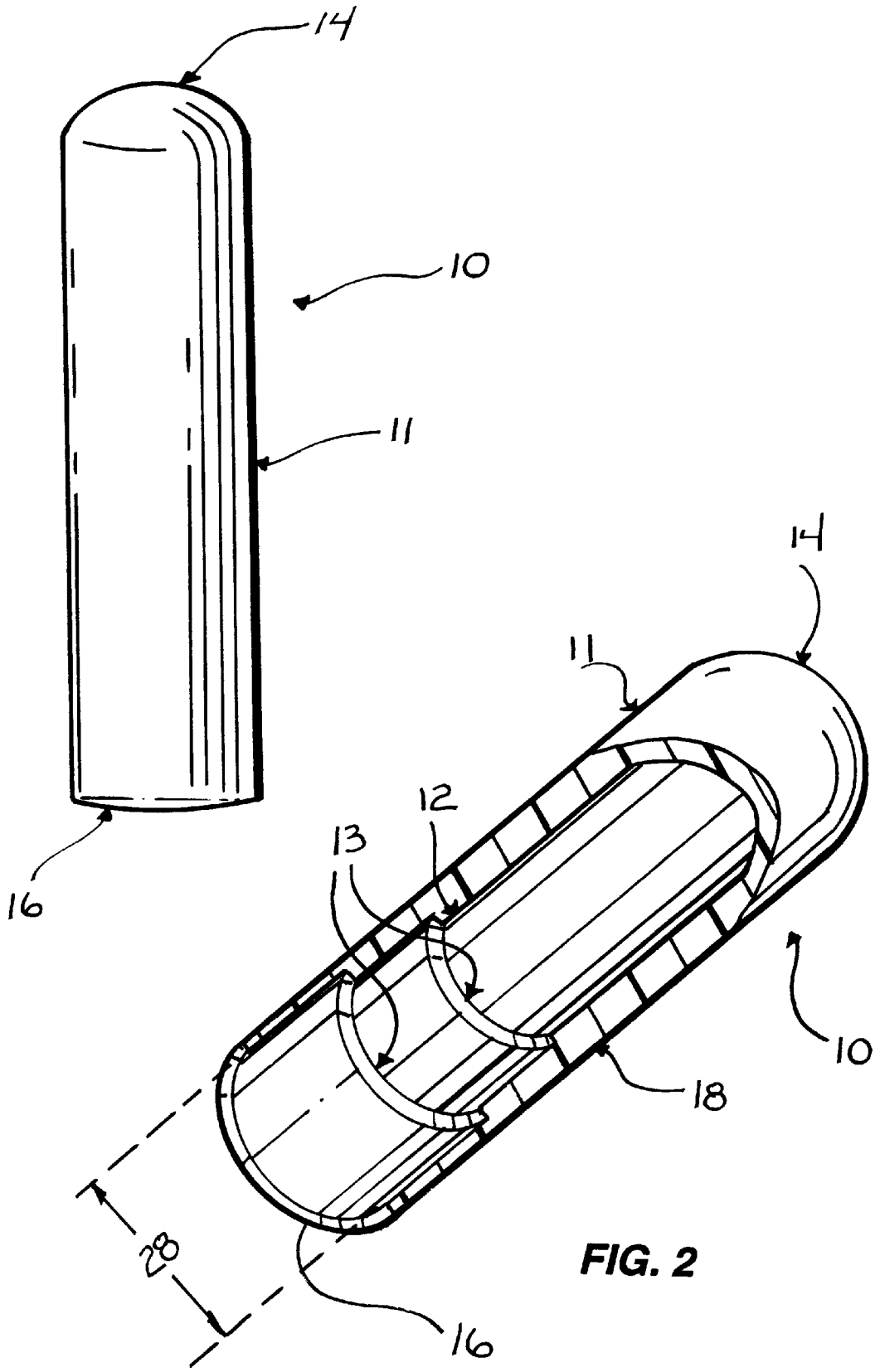
FIG. 2 shows a cut-away view and a perspective view of the lighting accessory.

The present invention, a lighting accessory 10, is useful to create voids or gaps in sequential lighting provided by ornamental light strings. These gaps or voids are created for a variety of different display situations, for example the spaces between words and even individual letters. FIG. 1 illustrates how the lighting accessory 10 is used to block the light emitted from lighting elements found in the space between the "J" and the "O", and the space between the "O" and the "Y" in the word "JOY".

Figure 3:
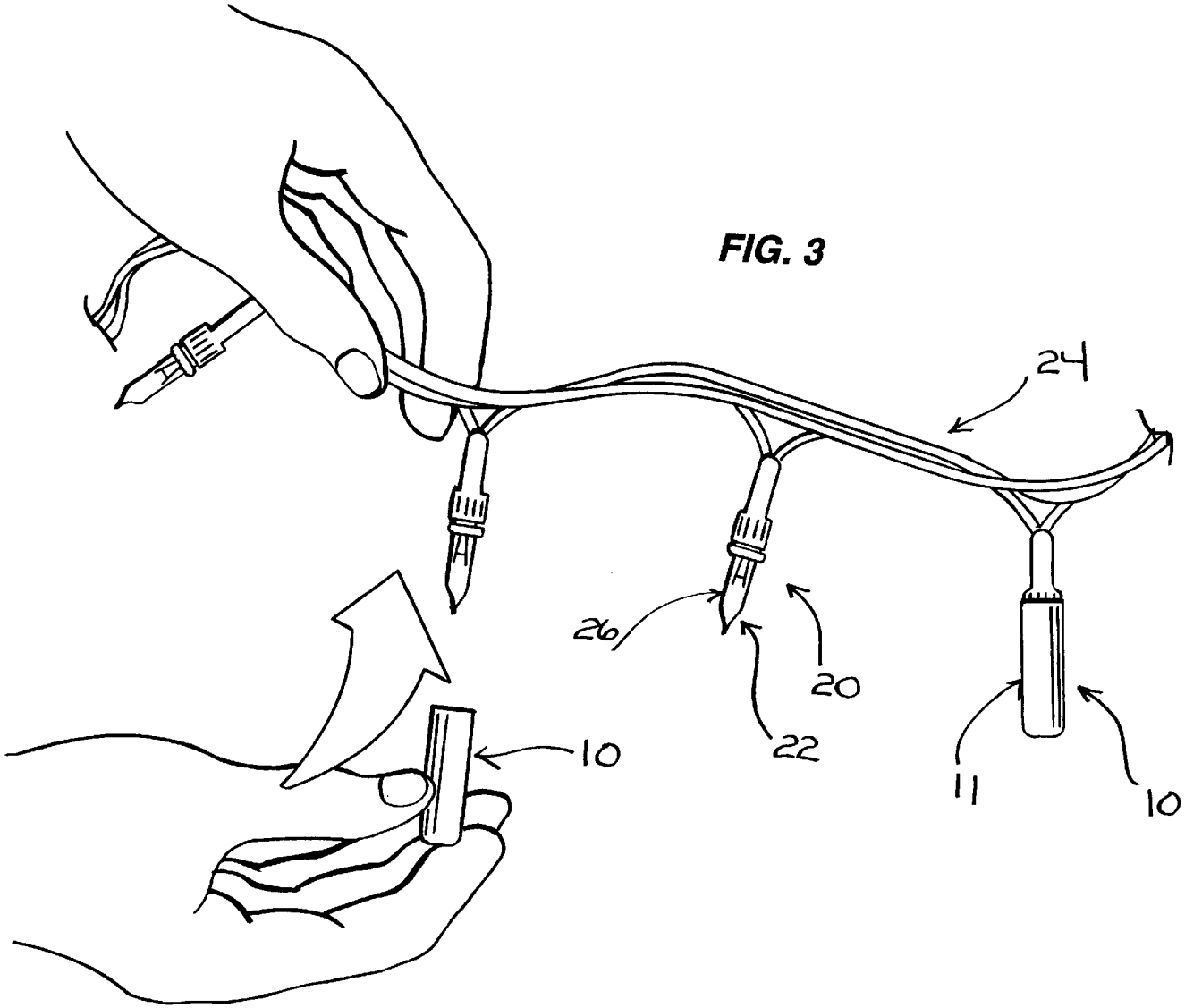
FIG. 3 shows the method of attaching the lighting accessory to one light emitting device of an ornamental lighting string.
Figure 4:
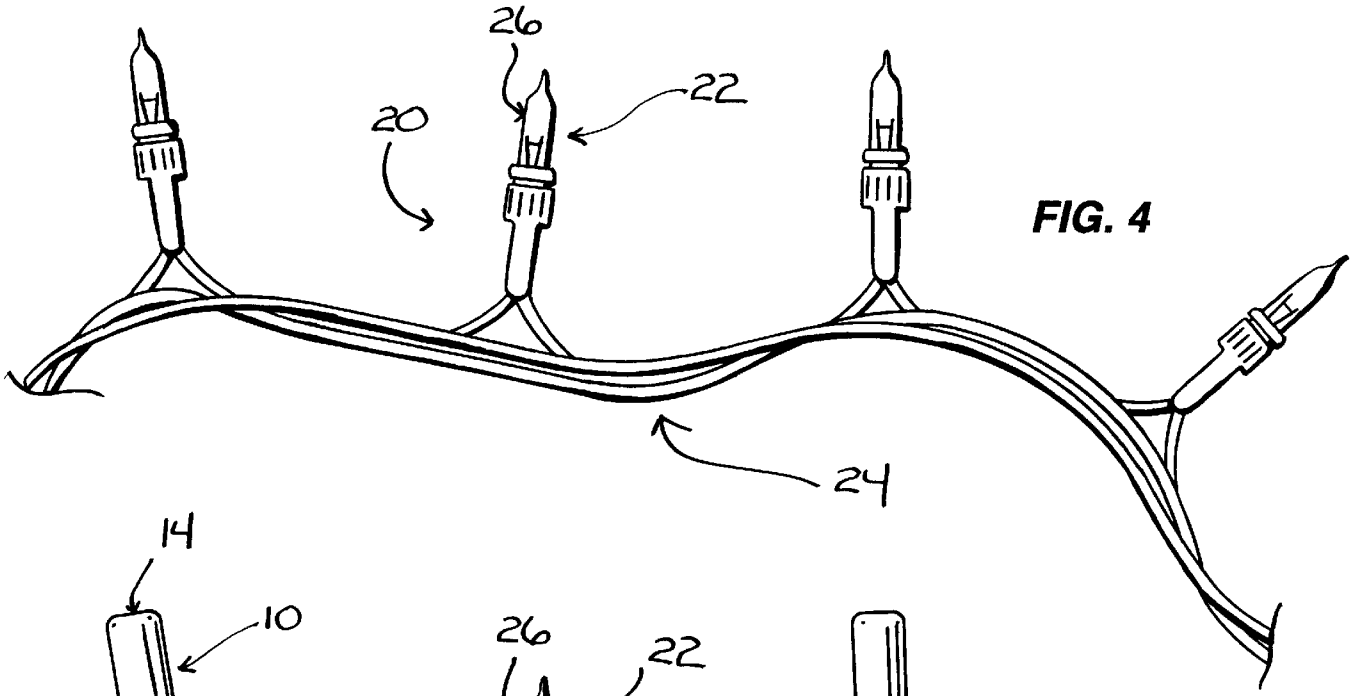
FIG. 4 shows an lighting string without any lighting accessories in use.
Figure 5:
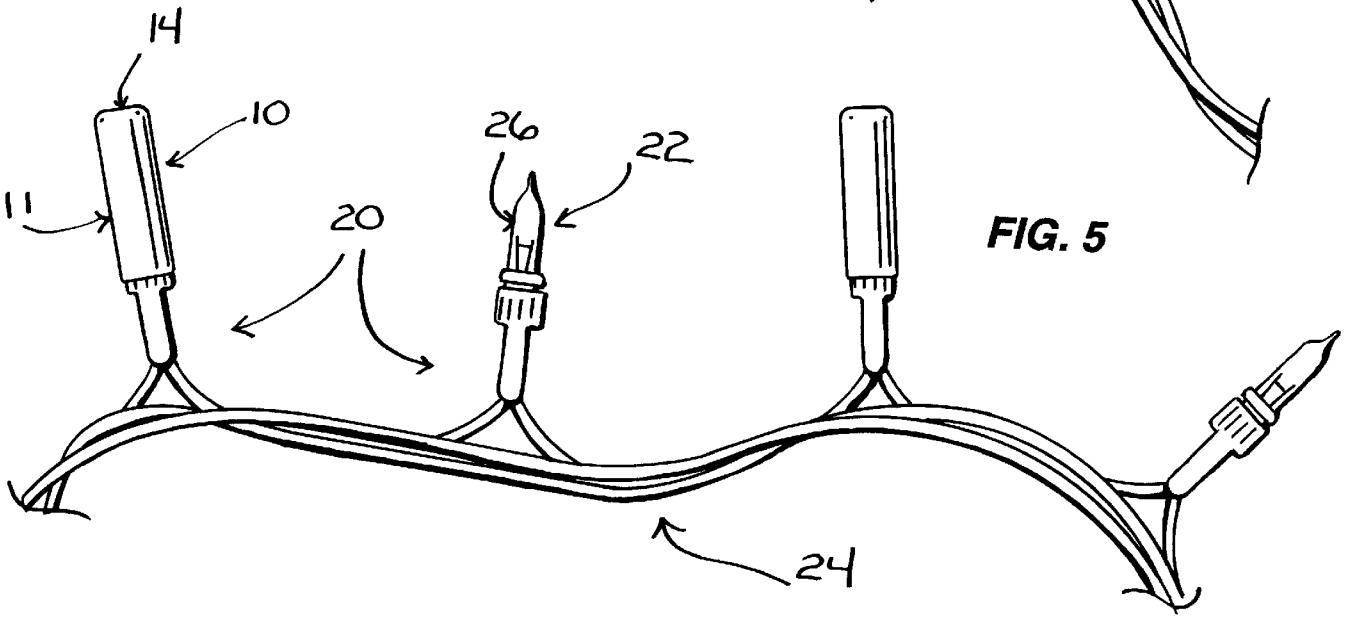
FIG. 5 shows an ornamental lighting string with two lighting accessories attached to two of the light emitting elements of an ornamental lighting string.
Figure 6:
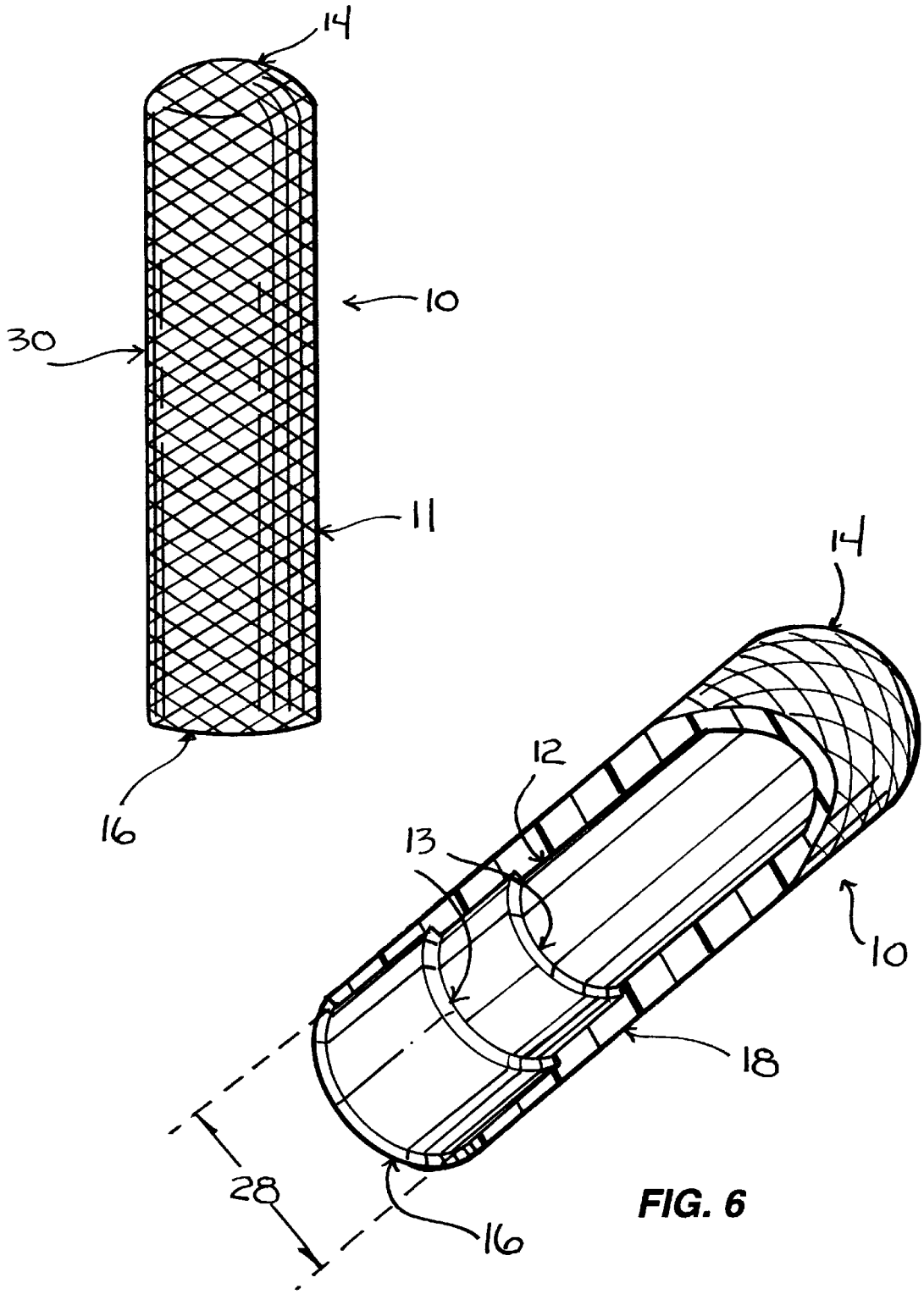
FIG. 6 shows the lighting accessory with a mesh design and construction.

With reference to the drawings, ornamental lighting strings 24 such as those used in holiday displays are typically a pair of electrical conductors with a plurality of light bulbs 22 or lighting elements 20 attached in either a parallel or a serial fashion. See FIG. 3. Commonly, as illustrated herein, the pair of electrical conductors of the lighting string each have two ends, one end attached to a male electrical plug member and the opposite end attached to a female electrical plug member. Each lighting element 20 has as a minimum at least one light bulb 22 or other illuminating device. A popular shape for the light bulb 22 used in ornamental light strings 24 is a substantially cylindrical transparent outer wall 26 that surrounds a resistance element.

A preferred embodiment of the lighting accessory 10 according to the present invention is an opaque structure that is removably attachable to selected individual lighting elements 20 of the ornamental lighting string 24. The preferred opacity in the lighting accessory 10 is such that the luminosity from the light bulb 22, to which the accessory 10 is attached, is substantially blocked so as to be not visible to a human observer.

Preferably, the lighting accessory 10 has a generally radially symmetric cylindrical body 11 with an inner wall 12 and an outer wall 18, the body further having two ends, an open end 14 and a closed end 16. One end 14 is closed with the remaining end 16 open and adapted to admit a lighting element 20 of an ornamental light string 24. The inner wall 12 should be long enough so as to cover the entire length of the transparent bulb 22 of the lighting element 20. Similarly, the diameter of the inner wall 12 should be in excess of the transparent bulb 22 of the lighting element 20. The excess diameter keeps the lighting accessory 10 from coming into direct contact with the light bulb 22 and helps prevent overheating of the entire light string 24 and accessory 10 assembly. The shape of the outer wall 18 is not critical and can be any shape and dimension that accommodates the inner wall 12. Since the bulb 22 shape and dimensions may vary without substantially affecting the light string 24 performance, the lighting accessory 10 may be adapted to match other light bulb 22 shapes and dimensions.

Alternate opacities for the lighting accessory 10 may be desirable to affect a dimmed luminosity used in some visual displays. The alternate opacities may be accomplished in the design and manufacture of the present invention by selecting a material that is less opaque or more transparent. Likewise, a similar effect can be achieved by including perforations or using a mesh design and construction 30 for the lighting accessory 10. Also, the structural walls 14 and 16 of the present invention can be designed and manufactured to be thinner. These alternate designs all operate to alter the resultant luminosity that is emitted from each lighting element 20 having an attached lighting accessory 10.

Attachment of the lighting accessory 10 to the light bulb 22 is preferably accomplished with friction. By design, the open end 16 and the inner wall 12 should have a diameter 28 substantially similar to, but slightly wider than, the largest transverse diameter of the transparent wall of the light bulb 22. On the inner wall 12, at least one lip 13 on the inner wall 14 affects a fit whereby the lighting accessory 10 is attached by friction to the light bulb 22. However, the fit adapted by the lip 13 on the inner wall 12 should be adapted so that the friction that holds the accessory 10 in place, can be overcome by the subtle pressure of a person's finger strength. This assures that no inordinate amount of pressure will be applied to the bulb 22 that would cause fracturing or shattering of the transparent bulb 22 material. When in place, the lighting accessory 10 prevents light emitted by the lighting element 20 from being seen by a remote observer.

The governing variables in material selection for the lighting accessory 10 are durability, hardness, temperature resistance and manufacturing costs. Although other material such as woods and metals could conceivably be used, plastic is the preferred material for construction of the accessory 10. As the lighting accessory 10 is intended to cover the lighting element 20, warm temperatures are likely to be achieved by the lighting accessory 10. Furthermore, the lighting element 20 will be off for substantial periods of time. Therefore, the construction material should be capable of sustained durability through a substantial number of thermal cycles.

While these descriptions directly describe the above embodiments, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A kit for decorative ornamentation comprising:

a) an ornamental lighting string having a plurality of lighting elements; in combination with b) at least one lighting accessory, each lighting accessory further being adapted to cover any of the lighting elements, and the at least one lighting accessories further is comprised of a body, which is a generally symmetric cylinder, with an inner wall, an outer wall and two ends, an open end and a closed end, whereby the lighting elements blocks substantially all of the luminosity visible to a person.

2. The kit as in claim 1 wherein the lighting accessories is constructed of a mesh design, whereby the mesh design blocks substantially all of the luminosity visible to a person.

3. The kit as in claim 1 wherein the lighting accessories body is constructed of a mesh design, whereby the mesh design blocks substantially all of the luminosity visible to a person.

4. The kit as in claim 3 wherein the open end of the body is sized to allow attachment to the light emitting devices by friction.

5. A lighting accessory for altering the luminosity of a light emitting device comprising;

a) a body having an inner wall wide enough to receive the widest transverse radius of a bulb of the light emitting device and an outer wall and the inner wall is generally a symmetric cylinder;

b) a closed end and an open end; and c) said body further having a length sufficient to cover the bulb of the light emitting device such that the body block substantially all of the luminosity visible to a person whereby the lighting accessory is removably attachable to the light emitting device.

6. The lighting accessory as in claim 5 wherein the open end further has an attached lip adapted to allow attachment of the lighting accessory to the light emitting device by friction.

7. The lighting accessory as in claim 6 wherein lip on the open end has a diameter slightly larger than the largest transverse radius of the light emitting device.

8. The lighting accessory as in claim 5 wherein the body is of mesh construction, whereby the mesh construction blocks substantially all of the luminosity visible to a person.

9. A kit for decorative ornamentation comprising:

a) an ornamental lighting string having a plurality of lighting elements; in combination with b) at least one lighting accessory, each lighting accessory further being adapted to cover any of the lighting elements, and the at least one lighting accessories further is comprised of a body with an inner wall, an outer wall and two ends, an open end and a closed end, whereby the lighting elements blocks substantially all of the luminosity visible to a person.

10. The kit as in claim 9 wherein the lighting accessories is constructed of a mesh design, whereby the mesh design blocks substantially all of the luminosity visible to a person.

11. The kit as in claim 9 wherein the lighting accessories body is constructed of a mesh design, whereby the mesh design blocks substantially all of the luminosity visible to a person.

12. The kit as in claim, 11 wherein the open end of the body is sized to allow attachment to the light emitting devices by friction.

* * * * *